US008538061B2

(12) United States Patent
Grinker et al.

(10) Patent No.: US 8,538,061 B2
(45) Date of Patent: Sep. 17, 2013

(54) EARPHONE DRIVER AND METHOD OF MANUFACTURE

(75) Inventors: Scott Charles Grinker, Vernon Hills, IL (US); Donald David Noettl, Chicago, IL (US); Matthew Louis Stoch, Lake Villa, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 537 days.

(21) Appl. No.: 12/833,683

(22) Filed: Jul. 9, 2010

(65) Prior Publication Data

US 2012/0008817 A1 Jan. 12, 2012

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl.
USPC ..... 381/409

(58) Field of Classification Search
USPC ..... 381/407–410, 371
See application file for complete search history.

(56) References Cited

U.S. PATENT DOCUMENTS

| | | | |
|---|---|---|---|
| 2,325,590 | A | 8/1943 | Carlisle |
| 2,430,229 | A | 11/1947 | Kelsey |
| 2,521,414 | A | 9/1950 | Schier |
| 2,808,468 | A | 10/1957 | Knauert |
| 2,971,065 | A | 2/1961 | Busse |
| 3,068,954 | A | 12/1962 | Strzalkowski |
| 3,265,819 | A | 8/1966 | Herrmann |
| 3,312,789 | A | 4/1967 | Lewis |
| 3,374,318 | A | 3/1968 | Martin |
| 3,529,102 | A | 9/1970 | Rosenstand |
| 4,295,066 | A | 10/1981 | Lloyd |
| 4,311,206 | A | 1/1982 | Johnson |

(Continued)

FOREIGN PATENT DOCUMENTS

| | | |
|---|---|---|
| DE | 2923865 | 11/1980 |
| DE | 3504891 | 9/1985 |

(Continued)

OTHER PUBLICATIONS

"Headphones," dated Aug. 21, 2007, retrieved from http://en.wikipedia.org/wiki/Headhpones, retrieved on Sep. 15, 2011, 11 pages.

(Continued)

*Primary Examiner* — Jeffrey Donels
(74) *Attorney, Agent, or Firm* — Banner & Witcoff, Ltd.

(57) ABSTRACT

A balanced armature motor assembly has a circuit board mounted to a bobbin. A first end of a wire coil is secured to a first terminal on the circuit board and passes through a first cutout of the bobbin. A second end of the wire coil is secured to a second terminal on the circuit board and passes through a second cutout of the bobbin. The first end of the wire coil is oriented along a first line tangent to a center post of the bobbin, and the second end of the wire coil is oriented along a second line tangent to the center post of the bobbin. In another embodiment, a compressed polymer material is interposed between a first magnet and a post located on the bobbin and between a second magnet and the post on the bobbin. The polymer material forces the first and second magnets into contact with the pole piece such that the magnets can be welded to the pole piece.

20 Claims, 20 Drawing Sheets

(56) References Cited

U.S. PATENT DOCUMENTS

| | | | | |
|---|---|---|---|---|
| 4,375,016 | A | 2/1983 | Harada | |
| 4,407,389 | A | 10/1983 | Johnson | |
| 4,418,787 | A | 12/1983 | Eggert | |
| 4,420,657 | A | 12/1983 | Larkin | |
| 4,443,668 | A | 4/1984 | Warren | |
| 4,473,722 | A | 9/1984 | Wilton | |
| 4,520,236 | A | 5/1985 | Gauthier | |
| 4,532,649 | A | 7/1985 | Bellafiore | |
| 4,592,370 | A | 6/1986 | Lee | |
| 4,607,720 | A | 8/1986 | Hardt | |
| 4,677,408 | A | 6/1987 | Bastian | |
| 4,706,778 | A | 11/1987 | Topholm | |
| 4,817,022 | A * | 3/1989 | Jornod et al. | 702/98 |
| 4,867,267 | A | 9/1989 | Carlson | |
| 4,870,688 | A | 9/1989 | Voroba | |
| 4,870,689 | A | 9/1989 | Weiss | |
| 4,879,750 | A | 11/1989 | Nassler | |
| 4,956,868 | A | 9/1990 | Carlson | |
| 4,969,534 | A | 11/1990 | Kolpe | |
| 4,987,597 | A | 1/1991 | Haertl | |
| 5,002,151 | A | 3/1991 | Oliveira | |
| 5,048,092 | A | 9/1991 | Yamagishi | |
| 5,068,901 | A | 11/1991 | Carlson | |
| 5,131,128 | A | 7/1992 | Bisgaard | |
| 5,193,116 | A | 3/1993 | Mostardo | |
| 5,220,612 | A | 6/1993 | Tibbetts | |
| 5,299,176 | A | 3/1994 | Tibbetts | |
| 5,319,163 | A | 6/1994 | Scott | |
| 5,327,506 | A | 7/1994 | Stites | |
| 5,390,254 | A | 2/1995 | Adelman | |
| D360,691 | S | 7/1995 | Mostardo | |
| D360,948 | S | 8/1995 | Mostardo | |
| D360,949 | S | 8/1995 | Mostardo | |
| D377,796 | S | 2/1997 | Hayashi | |
| 5,610,989 | A | 3/1997 | Salvage | |
| 5,647,013 | A | 7/1997 | Salvage | |
| 5,655,026 | A | 8/1997 | Peters | |
| 5,659,620 | A | 8/1997 | Kuhlman | |
| 5,661,420 | A | 8/1997 | Killion | |
| 5,682,020 | A | 10/1997 | Oliveira | |
| 5,687,244 | A | 11/1997 | Untersander | |
| 5,692,059 | A | 11/1997 | Kruger | |
| 5,708,721 | A | 1/1998 | Salvage | |
| 5,721,783 | A | 2/1998 | Anderson | |
| 5,753,870 | A | 5/1998 | Schlaegel | |
| 5,757,947 | A | 5/1998 | Van Halteren | |
| 5,784,471 | A | 7/1998 | Bebenroth | |
| 5,809,158 | A | 9/1998 | Van Halteren | |
| 5,887,070 | A | 3/1999 | Iseberg | |
| 5,960,093 | A | 9/1999 | Miller | |
| 6,041,131 | A | 3/2000 | Kirchhoefer | |
| 6,078,677 | A | 6/2000 | Dolleman | |
| 6,137,889 | A | 10/2000 | Shennib | |
| 6,205,227 | B1 | 3/2001 | Mahoney | |
| D453,119 | S | 1/2002 | Tsuchikiri | |
| 6,347,149 | B1 | 2/2002 | Bachmann | |
| D468,299 | S | 1/2003 | Boesen | |
| D468,300 | S | 1/2003 | Boesen | |
| D468,301 | S | 1/2003 | Fushimi | |
| 6,563,933 | B1 | 5/2003 | Niederdraenk | |
| 6,658,134 | B1 | 12/2003 | Van Hal | |
| 6,727,789 | B2 | 4/2004 | Tibbetts | |
| D490,399 | S | 5/2004 | Kamo | |
| 6,757,403 | B2 | 6/2004 | Urushibata | |
| 6,853,735 | B2 | 2/2005 | Imahori | |
| 6,909,613 | B2 | 6/2005 | Augustijn | |
| 6,931,142 | B2 | 8/2005 | Fushimi | |
| 7,024,010 | B2 | 4/2006 | Saunders | |
| 7,050,602 | B2 | 5/2006 | Miller | |
| 7,088,839 | B2 | 8/2006 | Geschiere | |
| 7,103,196 | B2 | 9/2006 | Warren | |
| 7,110,565 | B1 | 9/2006 | Engbert | |
| 7,164,776 | B2 | 1/2007 | Miller | |
| 7,190,803 | B2 | 3/2007 | Van Halteren | |
| 7,194,102 | B2 | 3/2007 | Harvey | |
| 7,194,103 | B2 | 3/2007 | Harvey | |
| 7,206,425 | B2 | 4/2007 | Vaudrey | |
| 7,206,428 | B2 | 4/2007 | Geschiere | |
| 7,236,609 | B1 | 6/2007 | Tsangaris | |
| 7,263,195 | B2 | 8/2007 | Harvey | |
| 7,317,806 | B2 | 1/2008 | Harvey | |
| 7,321,664 | B2 | 1/2008 | Van Banning | |
| 7,336,797 | B2 | 2/2008 | Thompson | |
| D567,217 | S | 4/2008 | Kamo | |
| 7,362,878 | B2 | 4/2008 | Miller | |
| 7,376,237 | B2 * | 5/2008 | Westerkull | 381/326 |
| 7,412,763 | B2 | 8/2008 | Jiles | |
| 7,415,125 | B2 | 8/2008 | Warren | |
| 7,489,794 | B2 | 2/2009 | Harvey | |
| 7,492,919 | B2 | 2/2009 | Engbert | |
| 7,529,379 | B2 | 5/2009 | Zurek | |
| 7,551,748 | B2 | 6/2009 | Kamo | |
| 2003/0034705 | A1 * | 2/2003 | Hakansson | 310/81 |
| 2004/0013282 | A1 * | 1/2004 | Coffin | 381/396 |
| 2004/0151334 | A1 | 8/2004 | Vaudrey | |
| 2006/0034480 | A1 * | 2/2006 | Simidian et al. | 381/396 |
| 2006/0153418 | A1 | 7/2006 | Van Halteren | |
| 2007/0189569 | A1 | 8/2007 | Haapapuro | |
| 2007/0201717 | A1 | 8/2007 | Dyer | |
| 2007/0258616 | A1 | 11/2007 | Tsangaris | |
| 2007/0274558 | A1 | 11/2007 | Lyon | |
| 2007/0291971 | A1 | 12/2007 | Halteren | |
| 2008/0019555 | A1 | 1/2008 | Llamas-Young | |
| 2008/0181443 | A1 | 7/2008 | Harvey | |
| 2008/0240485 | A1 | 10/2008 | Dyer | |
| 2009/0028356 | A1 | 1/2009 | Ambrose | |
| 2009/0041262 | A1 | 2/2009 | Harvey | |
| 2009/0060245 | A1 | 3/2009 | Blanchard | |
| 2009/0116677 | A1 | 5/2009 | Jones | |
| 2009/0147981 | A1 | 6/2009 | Blanchard | |
| 2009/0232341 | A1 | 9/2009 | Pinter | |
| 2012/0008804 | A1 * | 1/2012 | Bedwell et al. | 381/150 |
| 2012/0008814 | A1 * | 1/2012 | Alwicker et al. | 381/380 |

FOREIGN PATENT DOCUMENTS

| | | |
|---|---|---|
| GB | 1032548 | 6/1966 |
| GB | 2155276 | 9/1985 |
| GB | 2197158 | 5/1988 |
| GB | 2453434 | 8/2009 |
| NL | 7613904 | 6/1978 |
| WO | 9507014 | 3/1995 |
| WO | 0169963 | 9/2001 |
| WO | 2007038671 | 4/2007 |

OTHER PUBLICATIONS

"Balanced Armature," dated Aug. 21, 2007, retrieved from http://en.wikipedia.org/wiki/File"Bal_Arm.JPG, retrieved on Sep. 15, 2011, 4 pages.

International Search Report and Written Opinion dated Dec. 8, 2011, for PCT/US2011/042583, 19 pages.

Written Opinion for PCT/US2011/042583, dated Sep. 5, 2012, 5 pages.

* cited by examiner

Fig. 5A1
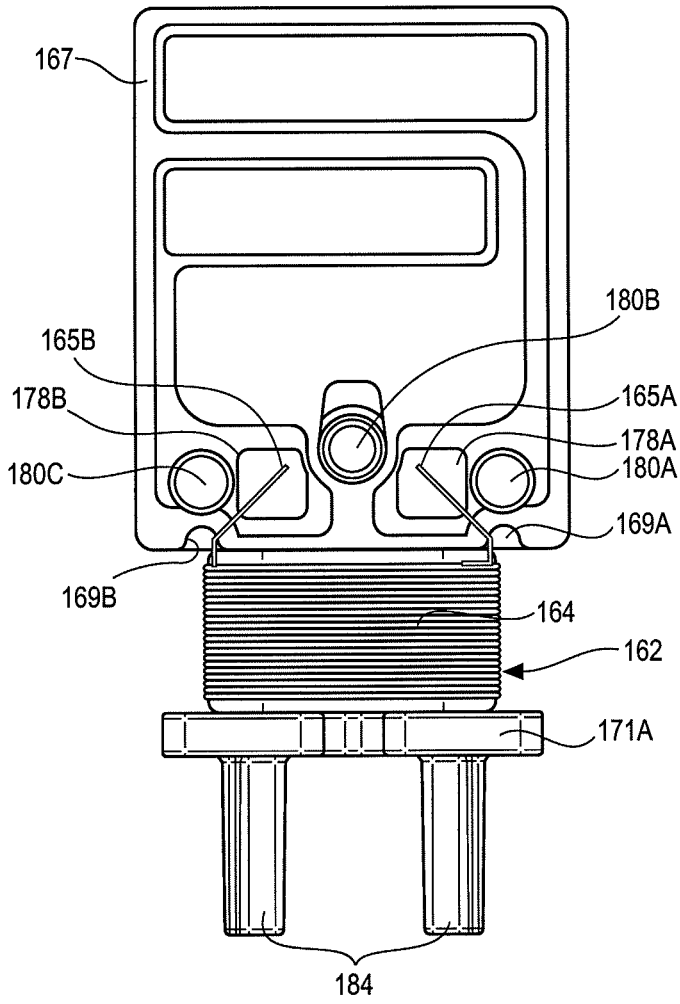

EARPHONE DRIVER AND METHOD OF MANUFACTURE

TECHNICAL FIELD

The disclosure herein relates to the field of sound reproduction, more specifically to the field of sound reproduction using an earphone. Aspects of the disclosure relate to earphones for in-ear listening devices ranging from hearing aids to high quality audio listening devices to consumer listening devices.

BACKGROUND

Personal "in-ear" monitoring systems are utilized by musicians, recording studio engineers, and live sound engineers to monitor performances on stage and in the recording studio. In-ear systems deliver a music mix directly to the musician's or engineer's ears without competing with other stage or studio sounds. These systems provide the musician or engineer with increased control over the balance and volume of instruments and tracks, and serve to protect the musician's or engineer's hearing through better sound quality at a lower volume setting. In-ear monitoring systems offer an improved alternative to conventional floor wedges or speakers, and in turn, have significantly changed the way musicians and sound engineers work on stage and in the studio.

Moreover, many consumers desire high quality audio sound, whether they are listening to music, DVD soundtracks, podcasts, or mobile telephone conversations. Users may desire small earphones that effectively block background ambient sounds from the user's outside environment.

Hearing aids, in-ear systems, and consumer listening devices typically utilize earphones that are engaged at least partially inside of the ear of the listener. Typical earphones have one or more drivers or balanced armatures mounted within a housing. Typically, sound is conveyed from the output of the driver(s) through a cylindrical sound port or a nozzle.

BRIEF SUMMARY

The present disclosure contemplates earphone driver assemblies, specifically balanced armature driver assemblies. The earphone driver assemblies can be used in any hearing aid, high quality listening device, or consumer listening device. For example, the present disclosure could be implemented in or in conjunction with the earphone assemblies, drivers, and methods disclosed Ser. No. 12/833,651, titled "Earphone Assembly" and Ser. No. 12/833,639 titled "Drive Pin Forming Method and Assembly for a Transducer," which are herein incorporated fully by reference.

The following presents a simplified summary of the disclosure in order to provide a basic understanding of some aspects. It is not intended to identify key or critical elements of the invention or to delineate the scope of the invention. The following summary merely presents some concepts of the disclosure in a simplified form as a prelude to the more detailed description provided below.

In one exemplary embodiment, a balanced armature motor assembly comprising: an armature having a flexible reed; a pole piece containing a pair of magnets; a bobbin comprising a first cutout, a second cutout, and a center post; a wire coil surrounding the bobbin having a first end and a second end; and a circuit board mounted to the bobbin is disclosed. The circuit board comprises a first terminal and a second terminal. A drive pin is operatively connected between the reed and a paddle. The first end of the wire coil is secured to the first terminal of the circuit board and passes through the first cutout of the bobbin and the second end of the wire coil is secured to the second terminal of the circuit board and passes through the second cutout of the bobbin. The first end of the wire coil is oriented along a first line tangent to the center post of the bobbin and the second end of the wire coil is oriented along a second line tangent to the center post of the bobbin. The circuit board comprises first and second notches, the first end of the wire coil is located in the first notch of the circuit board, and the second end of the wire coil is located in the second notch of the circuit board. The first cutout and the second cutout in the bobbin can be formed L-shaped.

In another exemplary embodiment, a method of forming a balanced armature motor assembly comprising an armature having a flexible reed, a pole piece containing a pair of magnets, a bobbin, a wire coil, a drive pin, a paddle, and a circuit board having first and second terminals thereon is disclosed. The method comprises wrapping a first end of a wire around a center post located on the bobbin; placing a portion of the first end of the wire in a first cutout located on the bobbin; wrapping a central portion of the bobbin with the wire to form the wire coil; locating a portion of a second end of the wire in a second cutout located on the bobbin; wrapping the second end of the wire around the center post; and affixing the first end of the wire to the first terminal and the second end of the wire to the second terminal. The method further comprises cutting the first end of the wire between the first terminal and the center post and discarding a first remainder portion of the first end wrapped around the center post and cutting the second end of the wire between the second terminal and the center post and discarding a second remainder portion of the second end wrapped around the center post. The first and second ends of the wire can be attached to the first and second terminals by a thermo-compression or soldering process.

In another exemplary embodiment a balanced armature motor assembly comprising: an armature having a flexible reed; a pole piece housing a first magnet and a second magnet; a bobbin having at least one post extending therefrom; a wire coil surrounding the bobbin; a circuit board mounted to the bobbin; a drive pin operatively connected to the reed and to a paddle is disclosed. A compressed polymer material can be interposed between the first magnet and the post and between the second magnet and the post. The polymer material forces the first and second magnets into contact with the pole piece. The polymer material comprises at least one glue dot secured to each of the first magnet and the second magnet or a plurality of glue dots located on each of the first magnet and the second magnet. The at least one post can comprise a pair of T-shaped posts. The at least one glue dot on the first magnet rests on a first side of the T-shaped posts, and the at least one glue dot on the second magnet rests on a second side of the T-shaped posts. The first magnet and the second magnet are further welded to the pole piece.

In another exemplary embodiment, a method of forming a balanced armature motor assembly comprising an armature having a flexible reed, a pole piece containing a first magnet and a second magnet, a bobbin, a wire coil, a drive pin, a paddle, and a circuit board is disclosed. The method comprises placing a polymer material on the first magnet and the second magnet; positioning the first magnet and the second magnet such that the polymer material contacts at least one post extending from the bobbin; placing the pole piece over the first magnet and the second magnet and compressing the polymer material to cause the polymer material to force the first magnet and the second magnet into contact with the pole piece; and securing the first magnet and the second magnet to the pole piece. The polymer material comprises an adhesive, and the adhesive can comprise a plurality of glue dots on each of the first magnet and the second magnet. The step of compressing the polymer material can comprise moving the magnets inwardly towards each other. The securing step can comprise welding the first and second magnets to the pole piece. The at least one post can comprise a pair of T-shaped posts extending from the bobbin. Additionally, the reed passes in between the first and second magnets, and is equidistant from the first and second magnets.

BRIEF DESCRIPTION OF THE DRAWINGS

The present disclosure is illustrated by way of example and not limited in the accompanying figures:

FIG. 5A1 shows the exemplary embodiment in FIG. 5A after an assembly operation;

DETAILED DESCRIPTION OF THE INVENTION

Figure 3A:
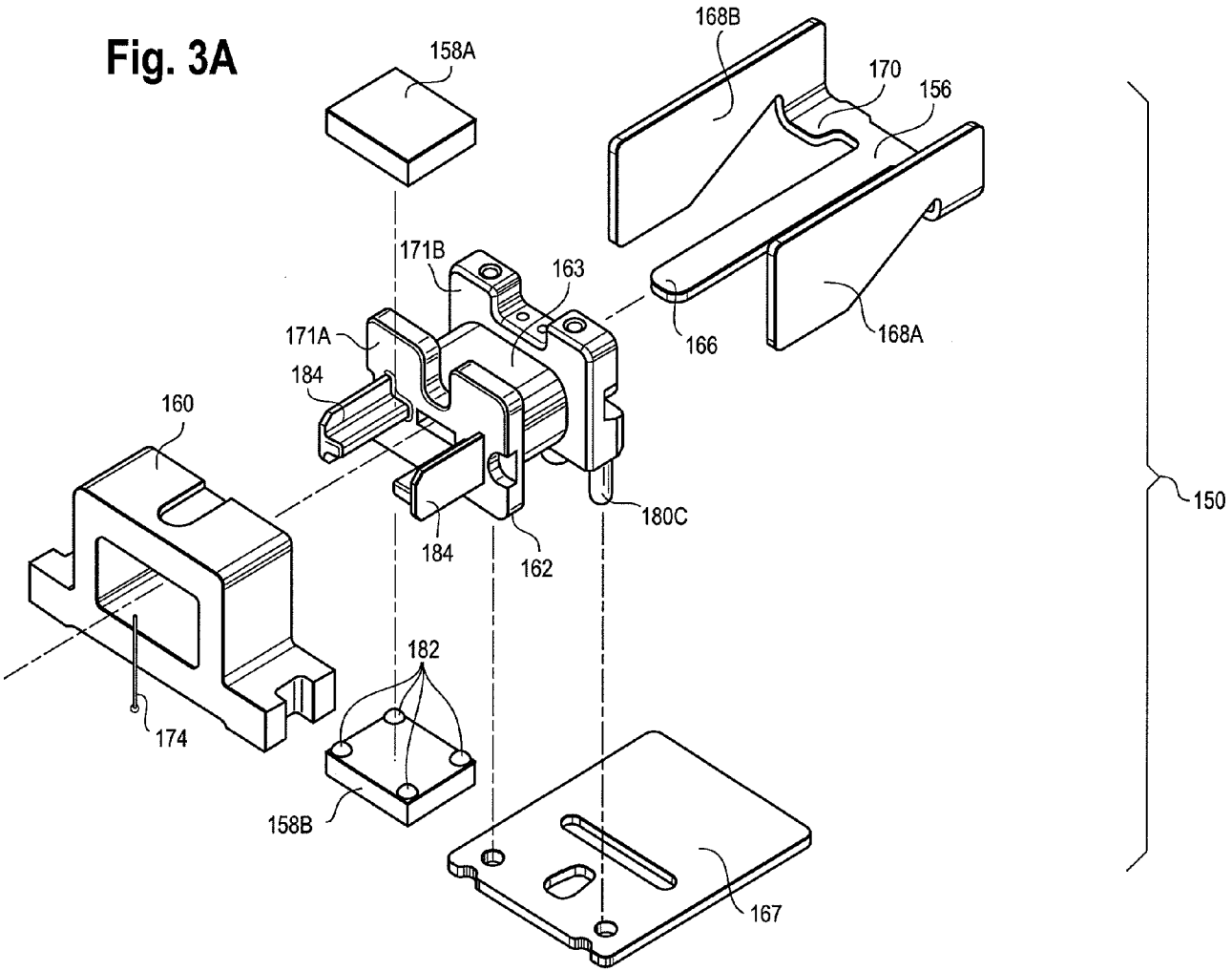
FIG. 3A shows a perspective exploded left front view of an exemplary embodiment of a balanced armature motor assembly disclosed herein.
Figure 3B:
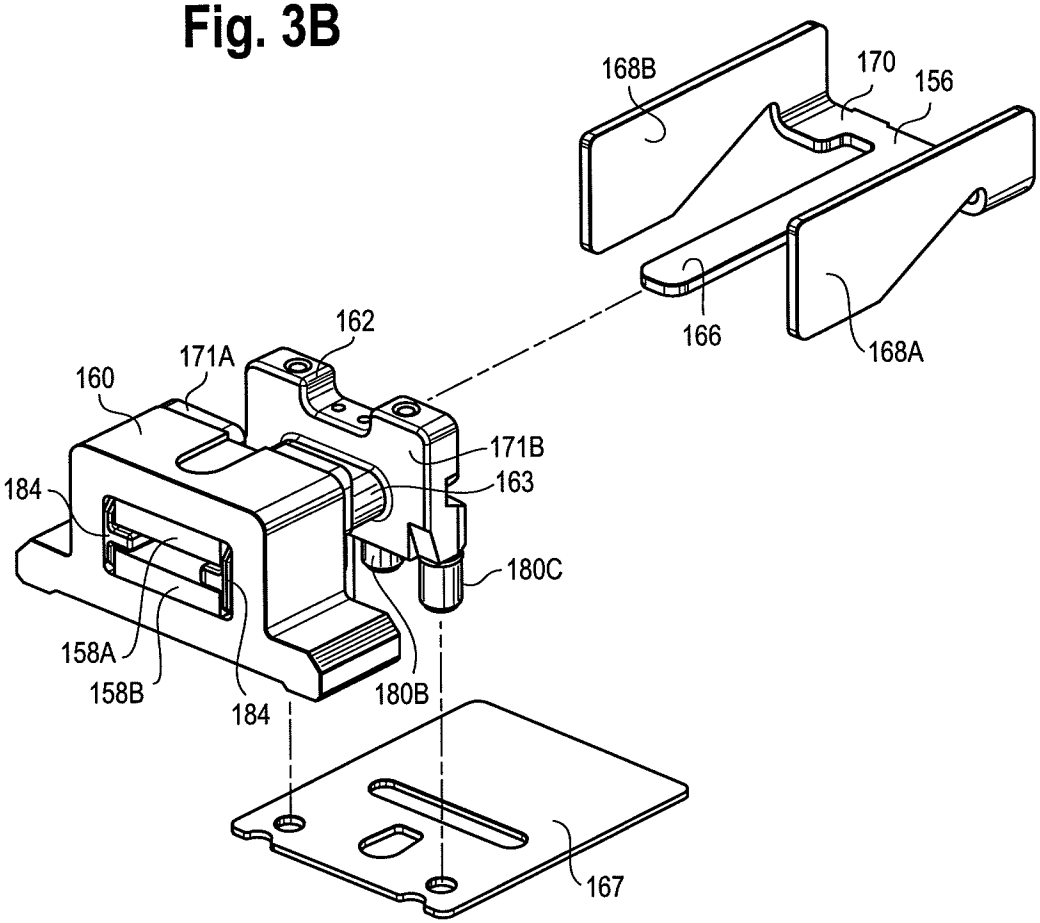
FIG. 3B shows another perspective exploded left front view of the balanced armature motor assembly in FIG. 3A.
Figure 3C:
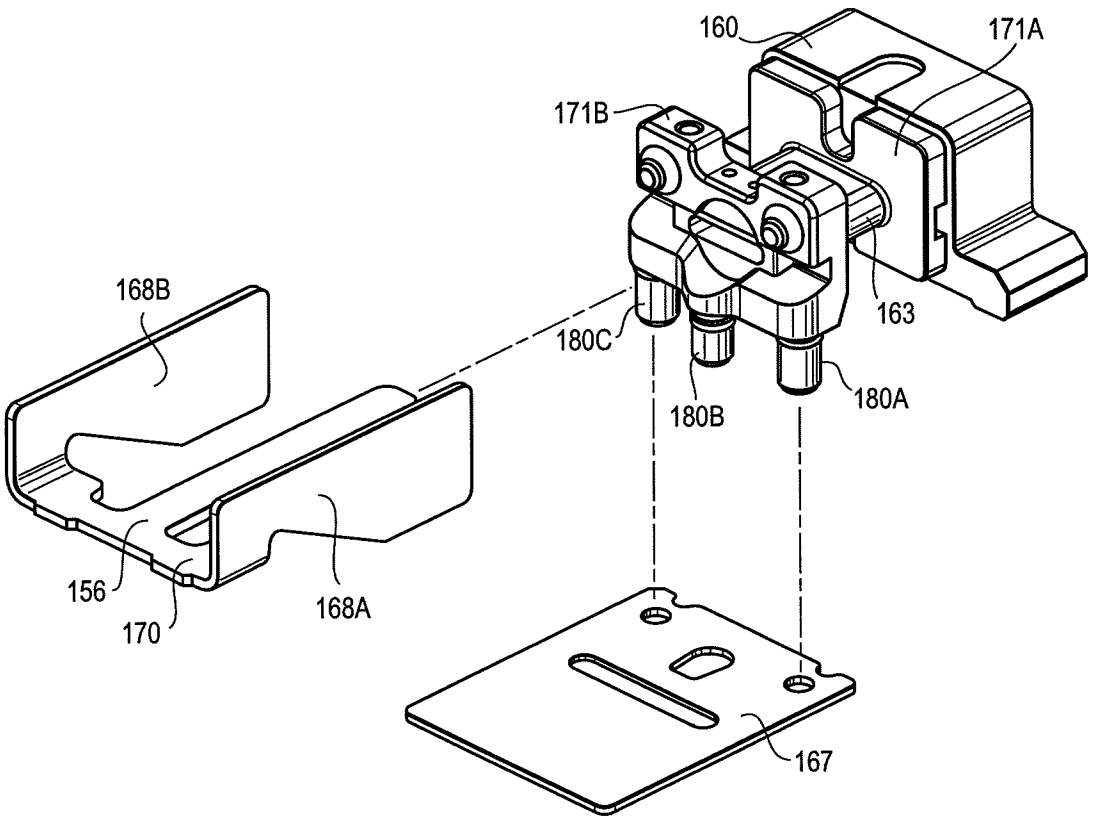
FIG. 3C shows a perspective exploded left rear view of the balanced armature motor assembly in FIG. 3A.
Figure 3D:
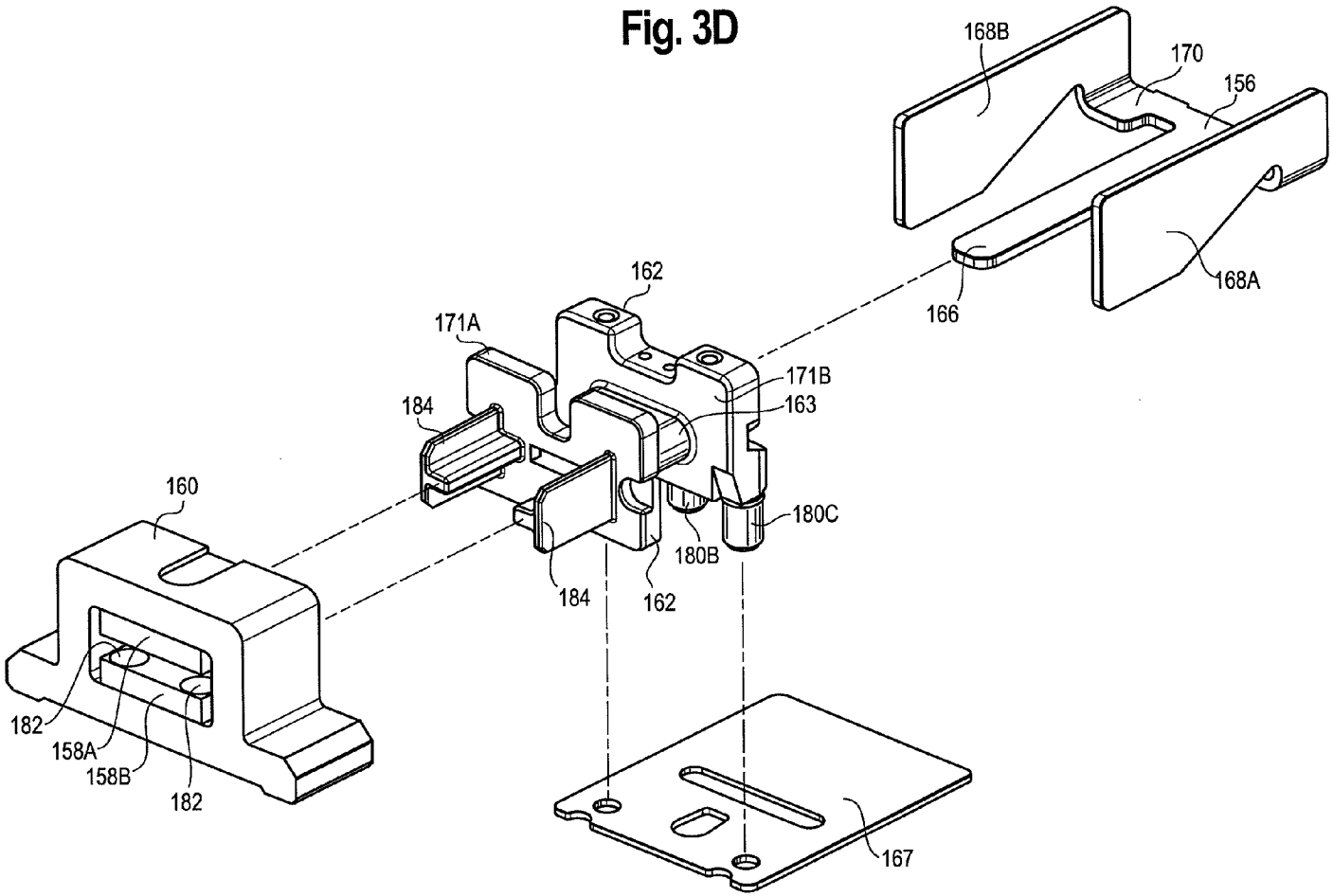
FIG. 3D shows another perspective left exploded front view of the balanced armature motor assembly in FIG. 3A.
Figure 3E:
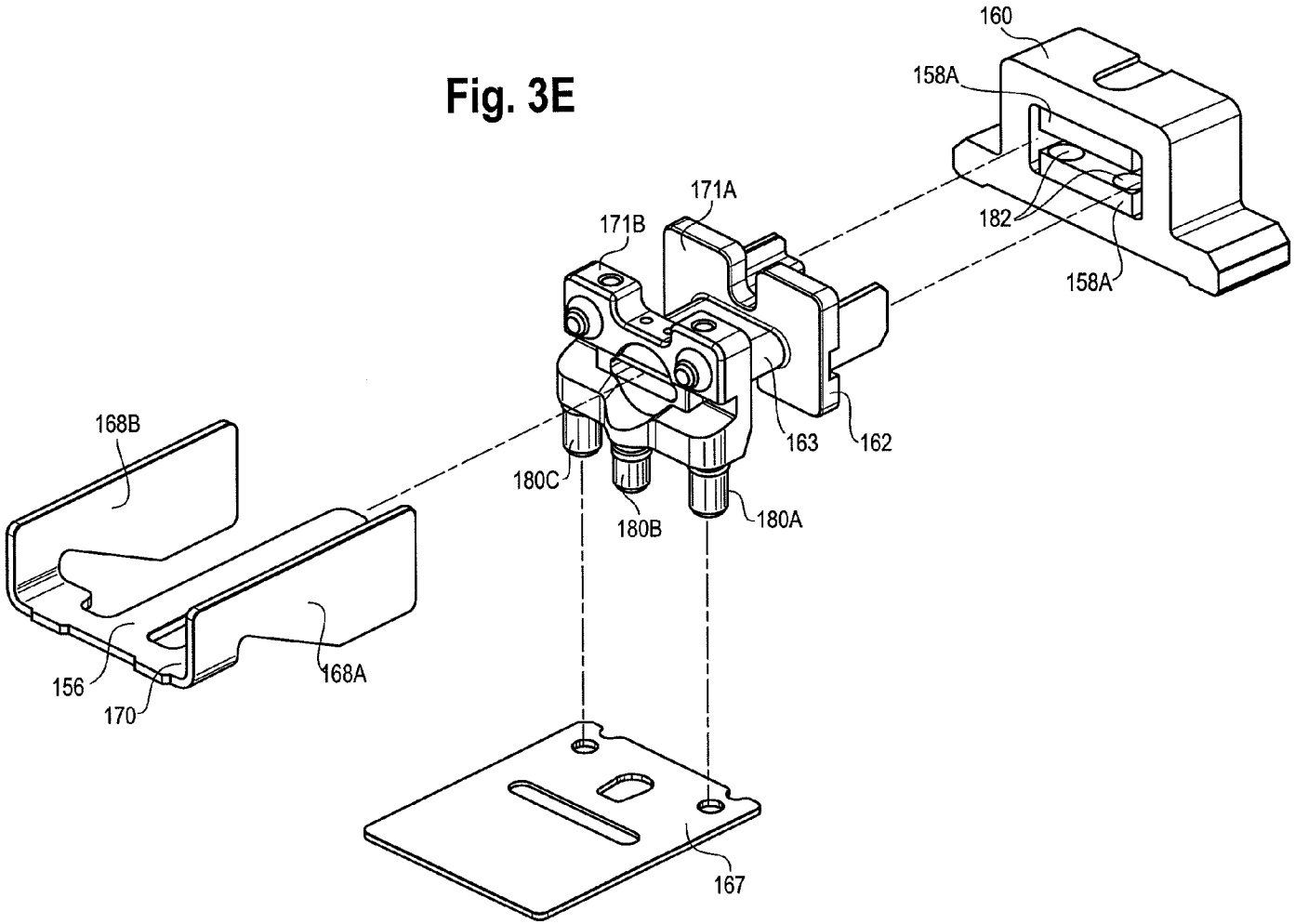
FIG. 3E shows another perspective exploded left rear view of the balanced armature motor assembly in FIG. 3A.
Figure 3F:
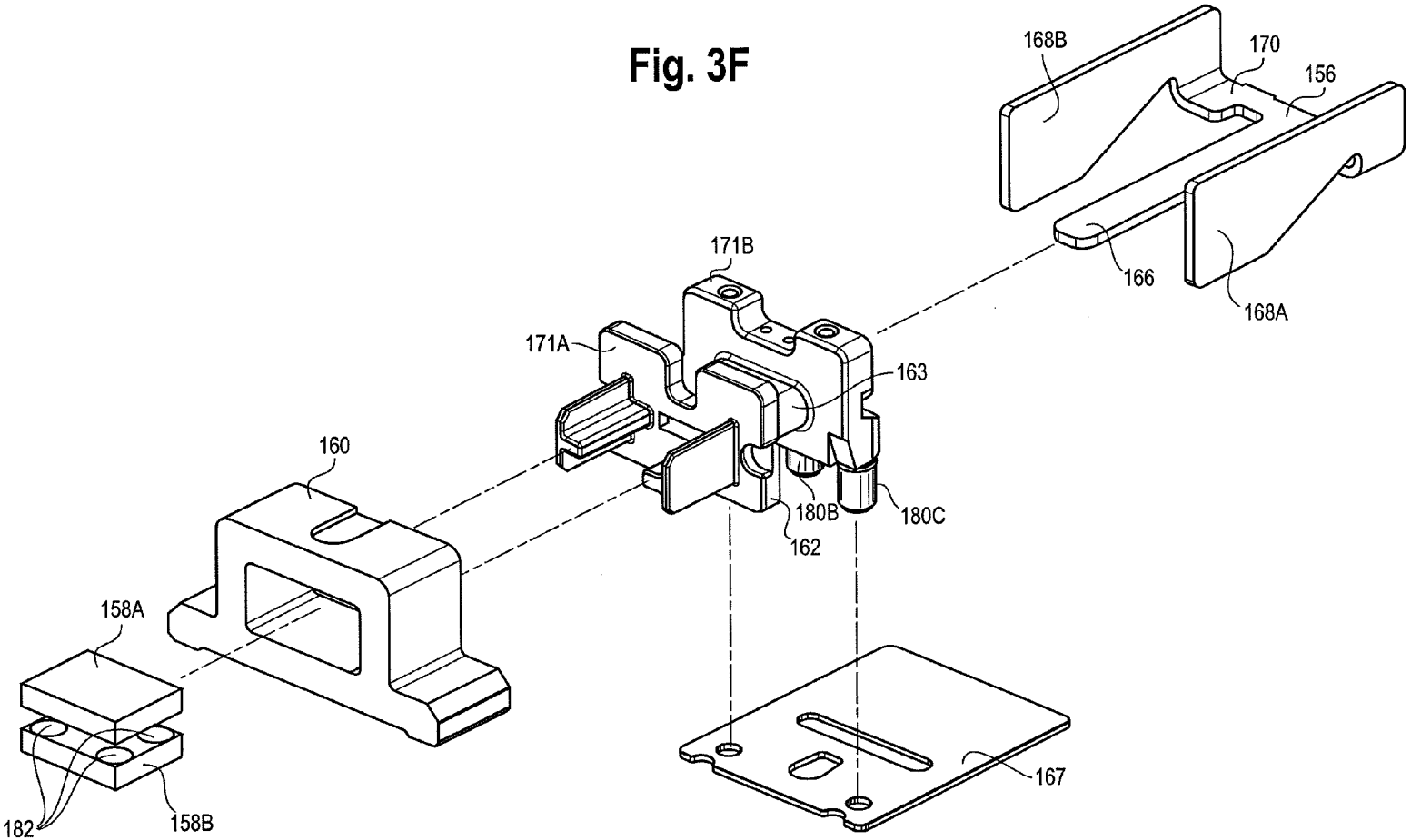
FIG. 3F shows another perspective exploded left front view of the balanced armature motor assembly in FIG. 3A.
Figure 3G:
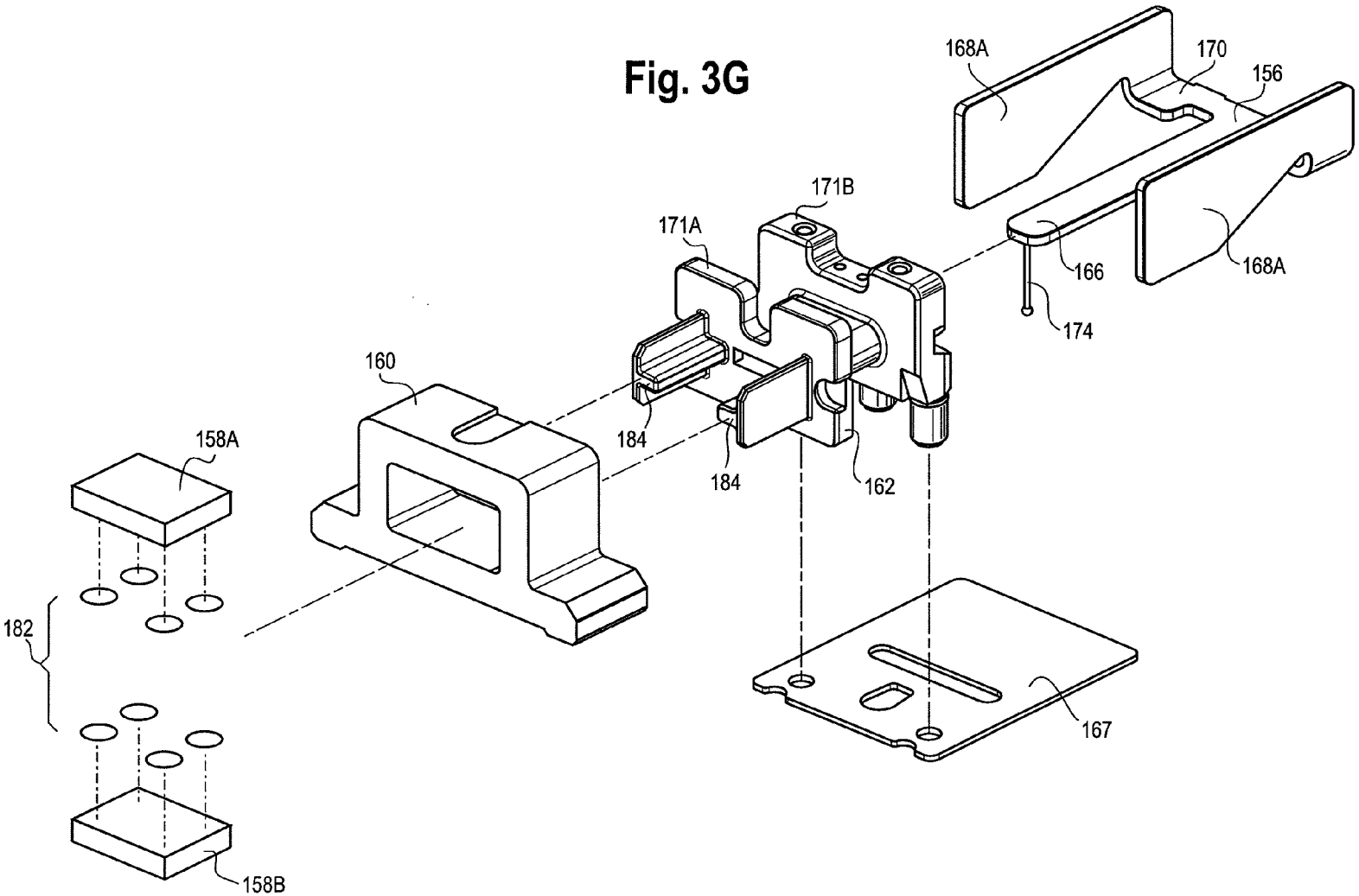
FIG. 3G shows another perspective exploded left front view of the balanced armature motor assembly in FIG. 3A.
Figure 4A:
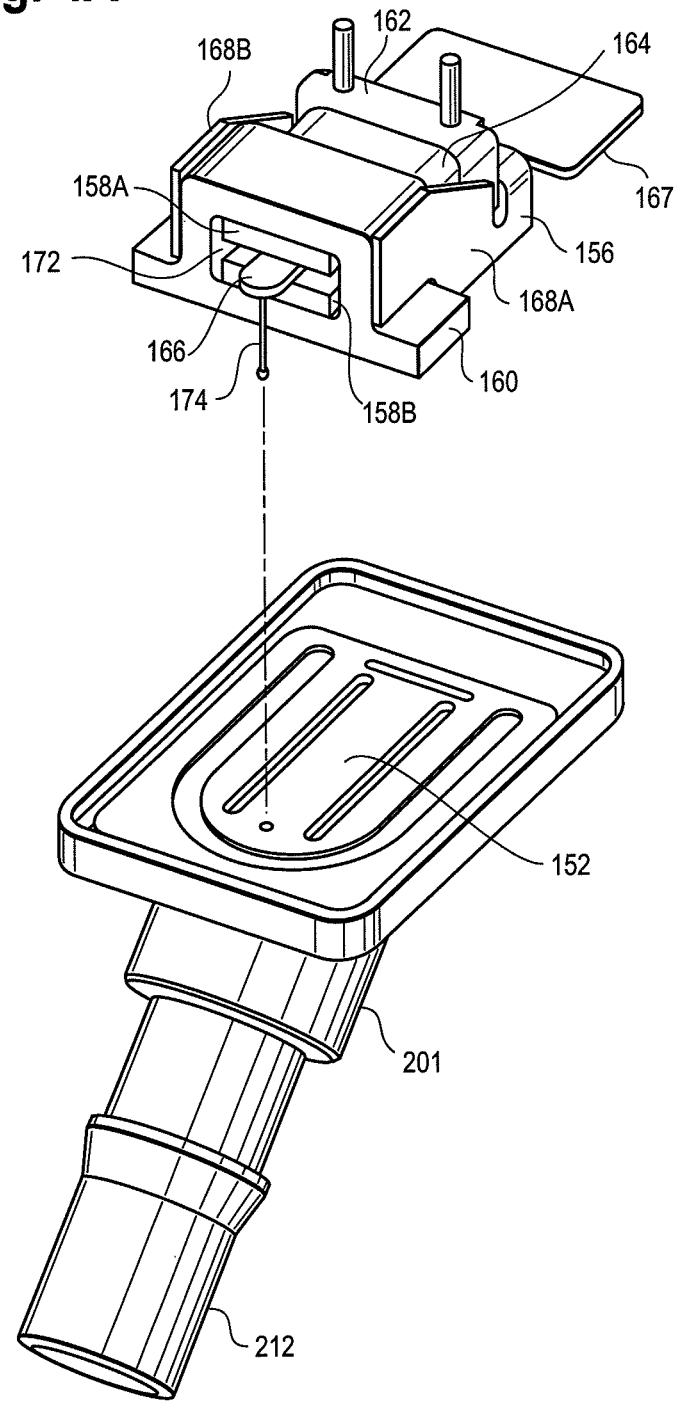
FIG. 4A shows an isometric left front view of the balanced armature motor assembly shown in FIG. 3A and a nozzle base.
Figure 4B:
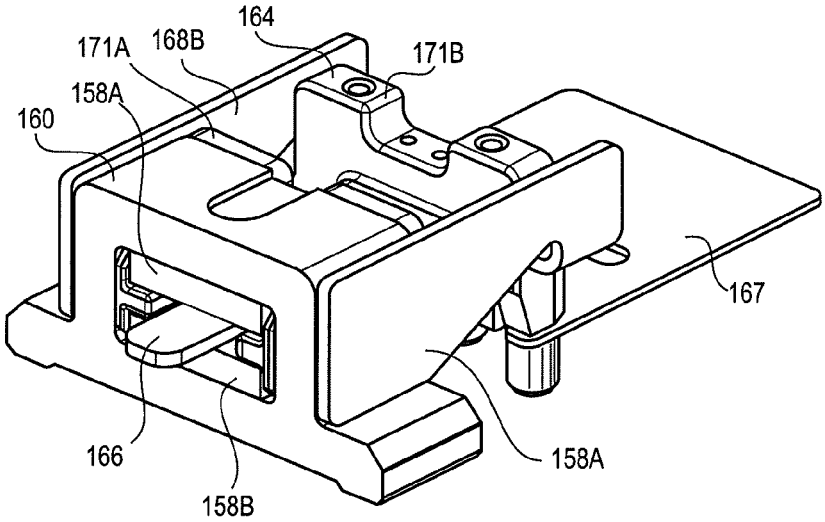
FIG. 4B shows another isometric left front view of the balanced armature motor assembly in FIG. 3A.
Figure 4C:
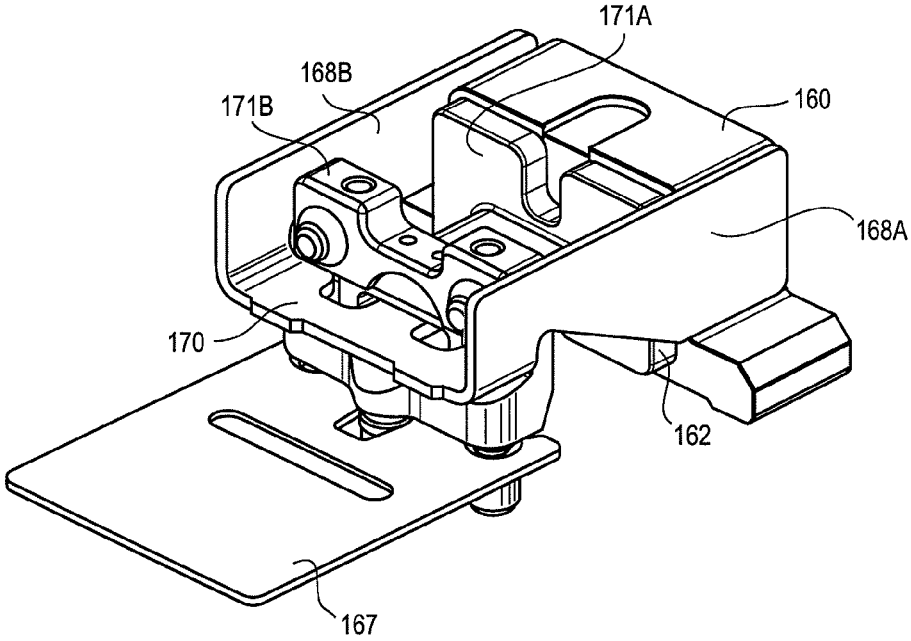
FIG. 4C shows an isometric left rear view of the balanced armature motor assembly in FIG. 3A.

Exploded views of a balanced armature motor assembly are shown in FIGS. 3A-3G and assembled views of a balanced armature motor assembly 150 are shown in FIGS. 4A, 4B, and 4C. Such a balanced armature motor assembly 150 can be used with any earphone ranging from hearing aids to high quality audio listening devices to consumer listening devices.

As shown in FIGS. 3A and 4A, a balanced armature motor assembly 150 generally consists of an armature 156, upper and lower magnets 158A, 158B, a pole piece 160, a bobbin 162, a coil 164, a drive pin 174, and a flex board 167 or any suitable type of circuit board. The magnets 158A, 158B are secured to the pole piece 160, and held in contact with the pole piece 160 by a plurality of glue dots 182 which provide a resilient force against a pair of "T" shaped posts 184 extending from the bobbin 162, as described in greater detail herein. While so held in place, the magnets 158A, 158B may be welded to the pole piece 160 as described in greater detail herein. The flex board 167 is a flexible printed circuit board that mounts to the bobbin 162 and free ends of wire forming the coil 164 are secured to the flex board 167 (as discussed in further detail herein).

The armature 156 is generally E-shaped from a top view. In other embodiments, the armature 156 may have a U-shape or any other known, suitable shape. The armature 156 has a flexible metal reed 166 which extends through the bobbin 162 and coil 164 between the upper and lower magnets 158A, 158B and is located equidistant from the upper and lower magnets 158A, 158B. The armature 156 also has two outer legs 168A, 168B, lying generally parallel with each other and interconnected at one end by a connecting part 170. As illustrated in FIG. 4A, the reed 166 is positioned within an air gap 172 formed by the magnets 158A, 158B. The two outer armature legs 168A and 168B extend along the outer side along the bobbin 162, coil 164, and pole piece 160. The coil 164 can be formed between two flanges 171A, 171B. The two outer armature legs 168A and 168B are affixed to the pole piece 160. The reed 166 can be connected to paddle 152 with the drive pin 174. The drive pin 174 can be formed of stainless steel wire or any other known suitable material.

Figure 1:
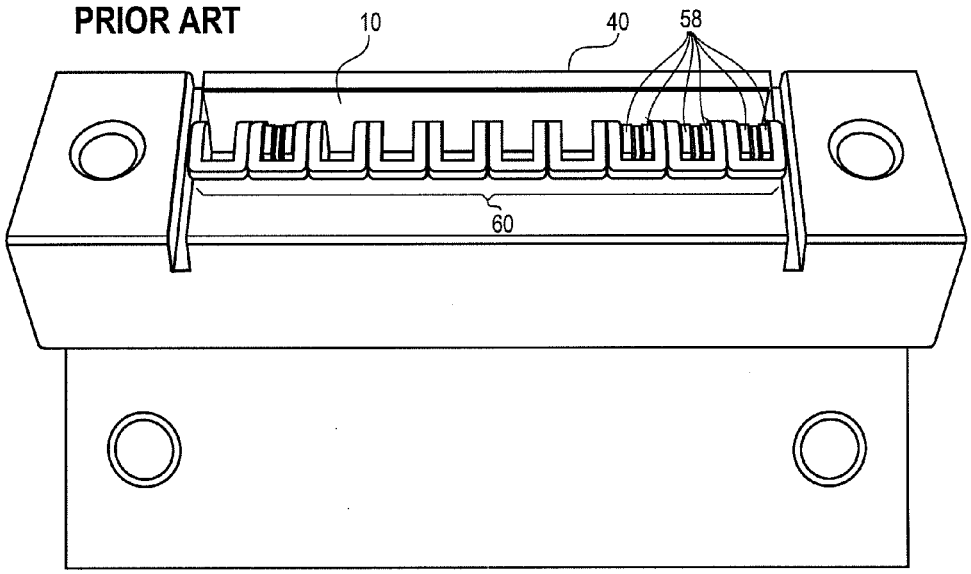
Fig. 1 PRIOR ART
FIG. 1 shows a perspective view of prior art fixture for assembling a balanced armature driver assembly.
Figure 5A:
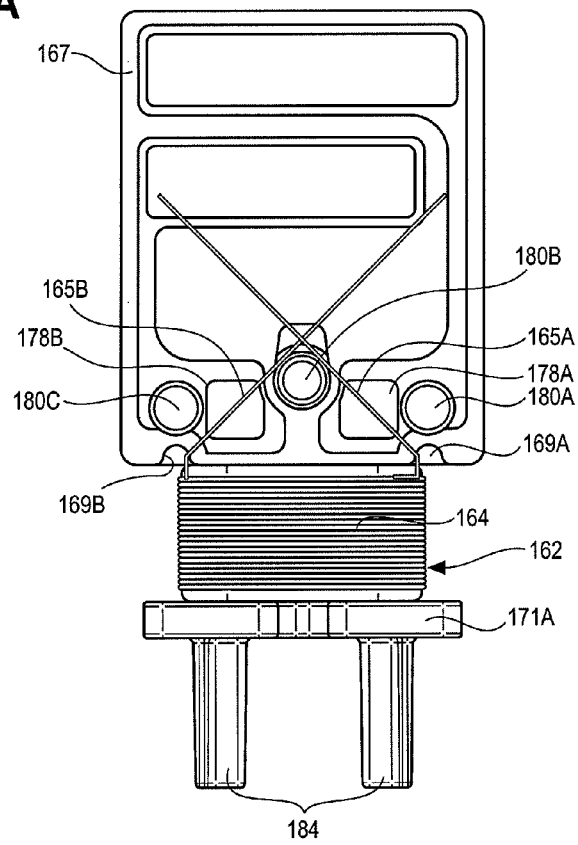
FIG. 5A shows a bottom view of another exemplary embodiment of a balanced armature motor assembly disclosed herein.

The electrical input signal is routed to the flex board 167 via a signal cable comprised of two conductors. Each conductor is terminated via a soldered connection or any suitable securing method to one more pads on the flex board 167 which are electrically connected (via the traces of the flex board 167) to the respective terminals 178A, 178B as shown in FIG. 5A1. In an embodiment, the pads are larger than the terminals 178A, 178B and thus serve the purpose of providing a larger surface area for connecting the signal cable conductors, which are relatively larger than the wire forming the coil 164. In an embodiment, the pads are located on an end of the flex board 167 generally opposite from the terminals 178A, 178B, as shown in FIGS. 5A and 5A1. Each of these terminals 178A, 178B is electrically connected to a corresponding lead 165A or 165B on each end of the coil 164. When signal current flows through the signal cable and into the coil's 164 windings, magnetic flux is induced into the soft magnetic reed 166 around which the coil 164 is wound. The signal current polarity determines the polarity of the magnetic flux induced in the reed 166. The free end of the reed 166 is suspended between the two permanent magnets 158A, 158B.

The magnetic axes of these two permanent magnets 158A, 158B are both aligned perpendicular to the lengthwise axis of the reed 166. The lower face of the upper magnet 158A acts as a magnetic south pole while the upper face of the lower magnet 158B acts as a magnetic north pole.

As the input signal current oscillates between positive and negative polarity, the free end of the reed 166 oscillates its behavior between that of a magnetic north pole and south pole, respectively. When acting as a magnetic north pole, the free end of the reed 166 repels from the north-pole face of the lower magnet and attracts to the south-pole face of the upper magnet. As the free end of the reed oscillates between north and south pole behavior, its physical location in the air gap 172 oscillates in kind, thus mirroring the waveform of the electrical input signal. The motion of the reed 166 by itself functions as an extremely inefficient acoustic radiator due to its minimal surface area and lack of an acoustic seal between its front and rear surfaces. In order to improve the acoustic efficiency of the motor, the drive pin 174 is utilized to couple the mechanical motion of the free end of the reed 166 to an acoustically sealed, lightweight paddle 152 of significantly larger surface area. The resulting acoustic volume velocity is then transmitted through the earphone nozzle 212 and ultimately into the user's ear canal, thus completing the transduction of the electrical input signal into the acoustical energy detected by the user.

As shown in FIG. 5A, the flex board 167 is formed with first and second terminals 178A, 178B. In an embodiment, during assembly, the ends of the wire forming the coil 164 are secured to the flex board 167 at the first and second terminals 178A, 178B. Stated differently, a start lead 165A or a first end of the coil 164 and a finish lead 165B or a second end of the coil 164 are affixed to the terminals 178A, 178B. The flex board 167 may optionally include first and second notches 169A, 169B for permitting the start and finish leads 165A, 165B of the coil 164 to rest in adjacent notches (or "L-shaped cutouts" 176A, 176B as described later herein) in the underlying bobbin 162 without distorting or putting pressure on the flex board 167.

Figure 5B:
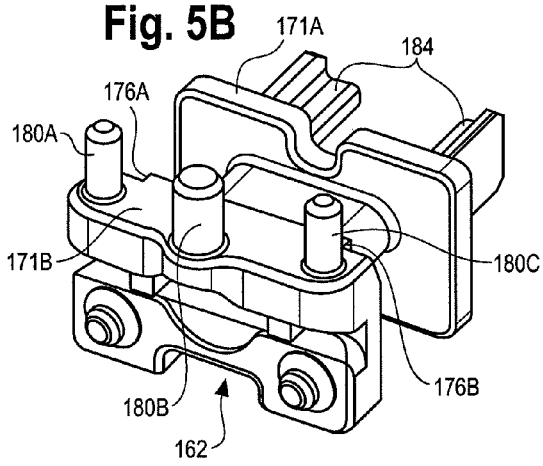
FIG. 5B shows a left rear perspective top view of the bobbin shown in FIG. 5A.
Figure 5C:
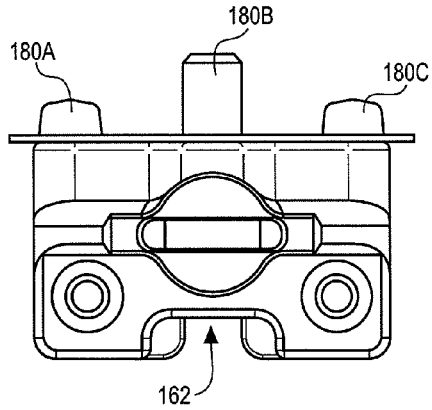
FIG. 5C shows a rear view of the balanced armature motor assembly of FIG. 5A.

The bobbin 162 has a spool 163, along with a first post 180A, a second or center post 180B, and a third post 180C. The first, second, and third posts 180A, 180B, 180C are used to locate the flex board 167 onto the bobbin 162, and the second or center post 180B is further used for securing the wire during the coiling process. More specifically, the second post 180B is used in conjunction with the L-shaped cutouts 176A, 176B described later herein to locate the start and finish leads 165A, 165B at appropriate locations relative to the first and second terminals 178A, 178B for affixing thereto. The center post 180B can also be configured so as to contact an earphone housing once assembled to provide for stability in preventing the motor assembly 150 from moving inside the earphone housing. Additionally, the center post 180B can aid in leveling the nozzle base 201 to keep the motor assembly 150 parallel to the paddle 152 plane while maintaining needed clearances. As shown in FIG. 5B, first and second L-shaped cutouts 176A, 176B may be provided on the bobbin 162 for locating the start lead 165A and the finish lead 165B properly over the first and second terminals 178A, 178B.

Specifically, the ends of the wires of the coil 164 which form the leads 165A, 165B pass through the L-shaped cutouts 176A, 176B, through the notches 169A, 169B of the flex board 167, pass diagonally over the terminals 178A, 178B of the flex board 167, and are wrapped around the center post 180B. It should be understood that the notches 169A, 169B are optional, and are present in some embodiments so as to avoid interference between the leads 165A, 165B and the flex board 167. In other embodiments, the flex board 167 may have no notches 169A, 169B and may instead be configured in different shapes and arrangements such that the leads 165A, 165B pass through the L-shaped cutouts 176A, 176B and over the terminals 178A, 178B without contacting any edges of the flex board 167.

The center post 180B and the L-shaped cutouts 176A, 176B in the bobbin 164 aid in maintaining the start lead 165A and the finish lead 165B properly in place over the terminals while the leads 165A, 165B are secured to the terminals 178A, 178B. This improves the manufacturability of the motor assembly 150 such that when the coil 164 is formed around the bobbin 162, the terminal leads 165A, 165B of the coil 164 can be properly and consistently located on the flex board 167 and affixed to the terminals 178A, 178B. Locating the leads 165A, 165B between the fixed structures of the L-shaped cutouts 176A, 176B and the center post 180B ensures that an appropriate and sufficient amount of wire from the leads 165A, 165B is in contact with the terminals 165A, 165B.

In an embodiment, during manufacturing, wire is wrapped around a central portion or spool 163 of the bobbin 162 to form the coil 164. This winding process may be done manually, may be done using an automated, machine-driven process, or may involve a combination of manual and automated steps. First, the wire is wrapped around the center post 180B approximately two to four times. Next, the wire is captured in the first L-shaped cutout 176A located on the bobbin 162, passing through the first notch 169A. Next the wire is wrapped around the spool 163 in layers with a specified number of turns per layer. In an embodiment, wire is wrapped around the spool 163 in eight (8) layers, with each layer having thirty-one turns of wire per layer. The wire is then captured in the second L-shaped cutout 176B located on the bobbin 162, passing through the second notch 169B. The wire is then again wrapped around the center post 180B approximately two to four times. The wire can then be cut to form the finish lead 165B. This process causes the start and finish leads 165A, 165B to be optimally positioned over the terminals 178A, 178B for securing the start and finish leads 165A, 165B to the terminals 178A, 178B, as described herein.

Once the start and finish leads 165A, 165B are properly positioned over the terminals 178A, 178B, they can be secured to the terminals 178A, 178B on the flex board 167 by any known appropriate method for connecting wires to metallic terminals, such as by a soldering or by a thermo-compression process. Once the leads 165A, 165B are secured to the terminals 178A, 178B, the wire of the start and finish leads 165A, 165B is cut near the second post 180B. The excess wire remaining around the center post 180B is trimmed such that it can be removed and discarded. In one exemplary embodiment the first end 165A of the wire is cut between the first terminal 178A and the center post 180B and a first remainder portion of the first end wrapped around the center post is discarded, and the second end 165B of the wire is cut between the second terminal 178B and the center post 180B and a second remainder portion of the second end wrapped around the center post 180B is discarded.

Thus, the resulting flex board 167 and bobbin 162 with finished leads 165A, 165B secured to terminals 178A, 178B appear as shown in FIG. 5A1. As shown in the resulting assembly in FIG. 5A1, the first end 165A of the wire coil 164 is oriented along a first line tangent to the center post 180B of the bobbin 162 and the second end 165B of the wire coil 164 is oriented along a second line tangent to the center post 180B of the bobbin 162.

Figure 2:
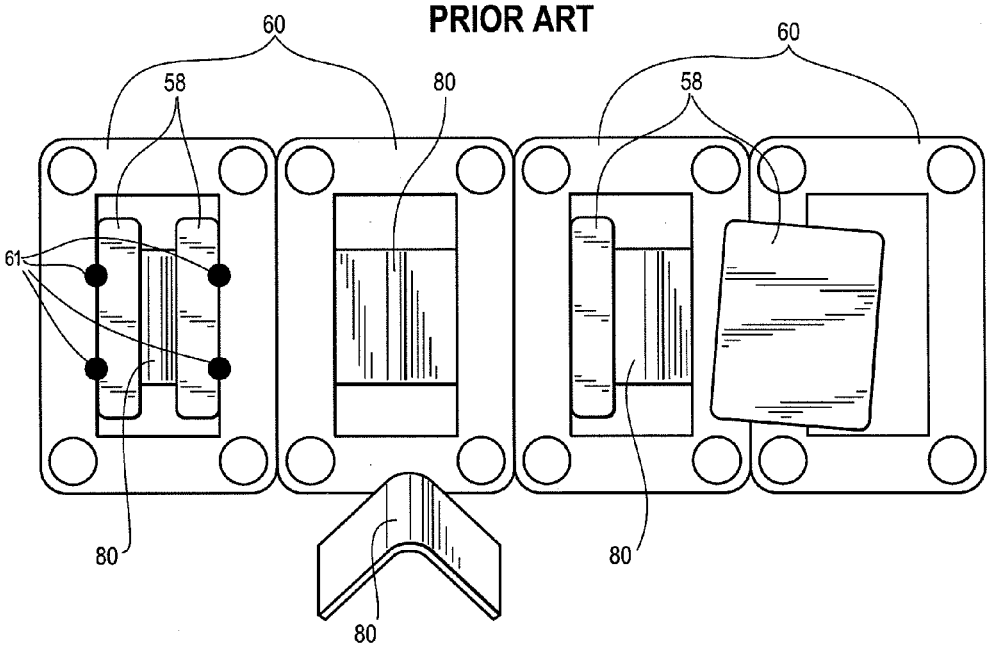
Fig. 2 PRIOR ART
FIG. 2 shows a close up perspective view of the prior art fixture of FIG. 1.

FIGS. 1 and 2 show a prior art assembly method for installing magnets 58 into a driver assembly. As shown in FIGS. 1 and 2, ten pole pieces 60 are loaded into a fixture block 40, while the magnets 58 are installed and held against the inner walls of each pole piece 60, using removable compliant spacers 80. A lateral spacer 10 is also used to center the magnets along the upper and lower pole piece 60 walls. The fixture block 40 is then installed in a laser welder and each magnet is accurately welded to the pole pieces 60 with two spot welds 61. Next the ten pole pieces 60 are removed and flipped around to perform the same welding operation on the other end in order to completely secure the magnets. A coil and bobbin is then fastened to the pole piece magnet sub-assembly with an adhesive.

Figure 7:
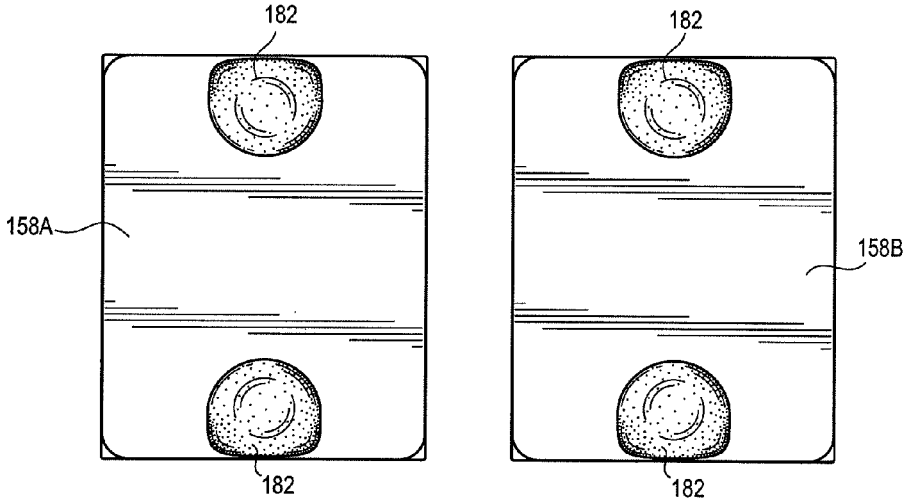
FIG. 7 shows a bottom view of a pair of magnets and corresponding glue dots used in an embodiment of a balanced armature motor assembly disclosed herein.
Figure 8:
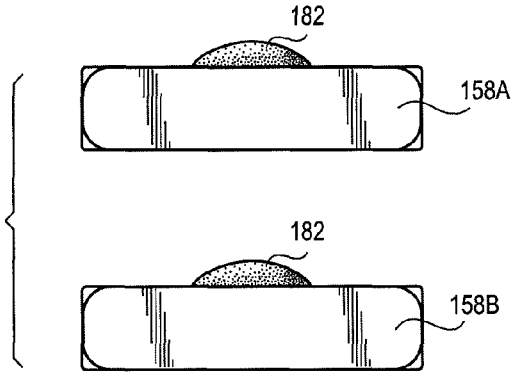
FIG. 8 shows an end view of the magnets and glue dots of FIG. 7.

In exemplary embodiments according to various aspects of the invention, as shown in FIGS. 3G and 7, a plurality of glue dots 182 are placed on the magnets 158, which aid in holding the magnets 158 against the pole piece 160 during welding the magnets to the pole piece 160. Although FIG. 3G depicts four glue dots 182 on magnets 158A, 158B and FIG. 7 depicts two glue dots 182 on magnets 158A, 158B, any suitable number of glue dots 182 is contemplated. FIG. 8 shows a side profile of the glue dots 182 on magnets 158A, 158B. As shown in FIG. 8, in an embodiment, the glue dots 182 have a generally hemispherical shape. In other embodiment, the glue dots 182 may take on a variety of shapes and configurations.

Figure 6A:
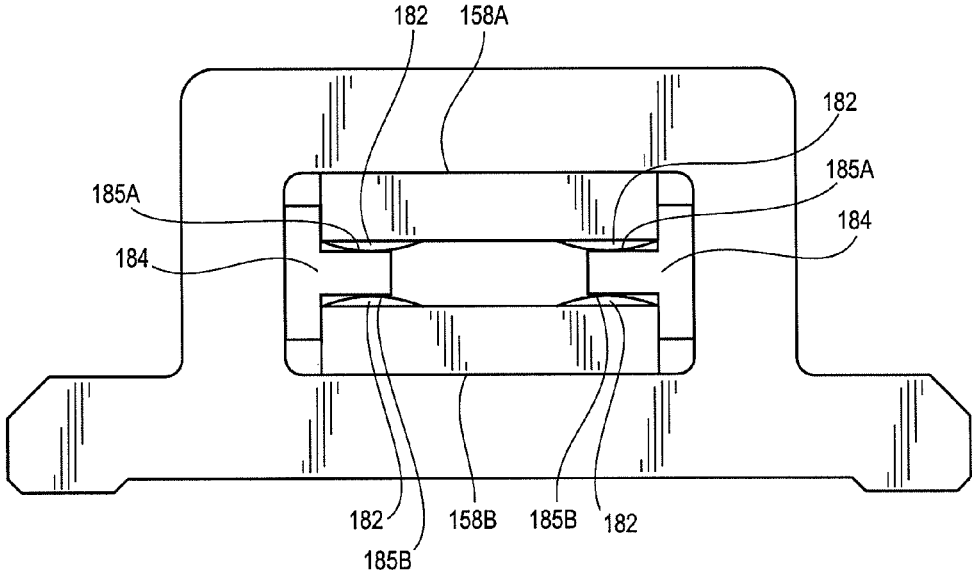
FIG. 6A shows a front view of another exemplary embodiment of a balanced armature motor assembly prior to a welding operation disclosed herein.
Figure 9:
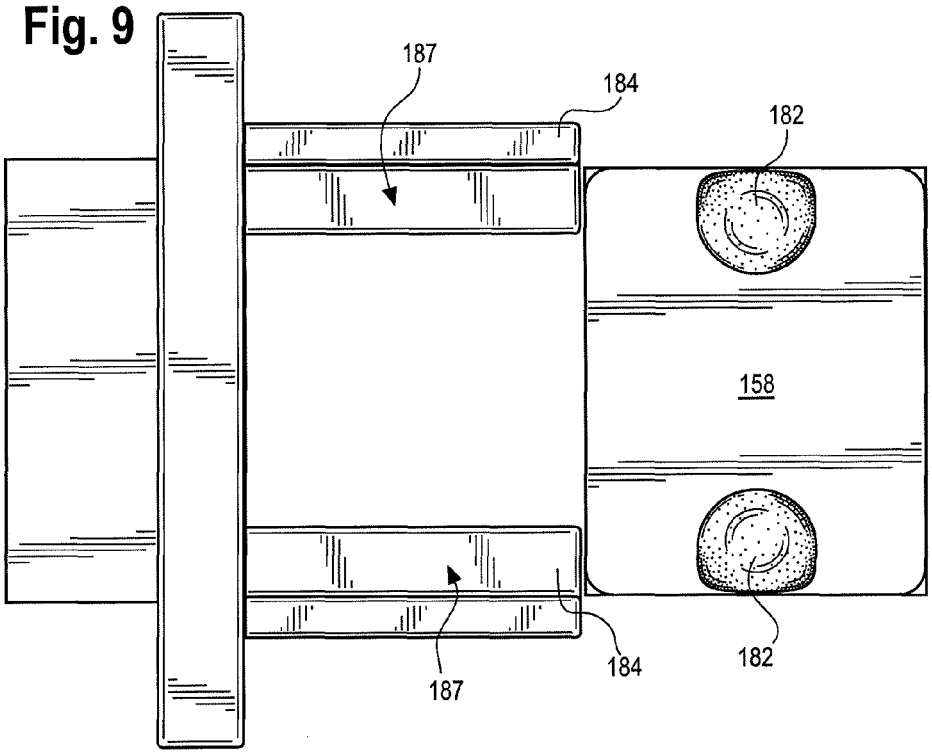
FIG. 9 shows a top view of another exemplary embodiment of an unassembled balanced armature motor assembly disclosed herein.

As shown in FIGS. 5A and 5B, the bobbin 162 incorporates two "T" shaped posts 184 extending from a front flange 171A on the bobbin 162 to locate and support the magnets 158 and the pole piece 160. The "T" shaped posts 184 aid in assembling the magnets 158 to the pole piece 160. FIG. 9 shows glue dot contact points 187 on opposing surfaces or sides of the "T" shaped posts 184. As shown in FIG. 6A, the "T" posts 184 have first sides 185A and second sides 185B and the magnets 158A, 158B are positioned on each of the first sides 185A and the second sides 185B of the "T" shaped posts 184, with the glue dots 182 in contact with the first and second sides 185A, 185B of the T-shaped posts 184. Although in this embodiment glue "dots" are discussed, the resilient glue or adhesive used can take on other shapes and configurations, such as a strip or line of glue, Additionally, other types of suitable polymers in place of the glue dots are also contemplated. In addition, it is also contemplated that the glue could be placed onto first and second sides 185A, 185B or other appropriate locations on the "T" shaped posts 184 instead of the magnets 158. In addition, other shapes and configurations of the "T" posts are contemplated, for example the posts 184 can be formed as straight posts, legs, or flat narrow strips.

The purpose of the glue dots 182 is to aid the assembly of the magnets 158 into the pole piece 160 and provide an improved structure to the balanced armature driver assembly 150 as a whole. It is desirable for the magnets 158 to be held tight against the upper and lower walls of the pole piece 160. In order to complete the magnetic flux path, it is preferable for performance reasons to minimize or eliminate the existence of any air gaps between the pole piece 160 and magnets 158. The glue dots 182 provide a resilient, spring-like structure to hold the magnets 158 tightly against the interior of the pole piece 160 while welding the magnets 158 to the pole piece 160. In one embodiment shown in FIG. 6B, a plurality of welds 161A-D are placed between the magnets 158A, 158B and the pole piece 160. Thus, in one respect, the glue dots 182 replace and perform the function of the compliant spacers 80 in the prior art (see FIGS. 1 and 2). In addition to glue, other suitable polymers, such as cured silicon rubber, can be secured to the magnets to provide this resilient function.

According to one embodiment of the present invention as shown in FIGS. 11A-11K, during assembly the magnets 158 are positioned on either side of the "T" shaped posts 184, compressed and/or "tilted forward" at their front ends, and then captured by the pole piece 160 as it is slid over the magnets 158. In an embodiment, an assembly fixture 186 can be used to aid the assembly of the magnets 158 to the bobbin 162 and the pole piece 160. In an embodiment, an assembly fixture 186 can be used to aid the assembly of the magnets 158 to the bobbin 162 and the pole piece 160. In particular, the assembly fixture 186 holds and manipulates the magnets 158 as the pole piece 160 is added.

Figure 11A:
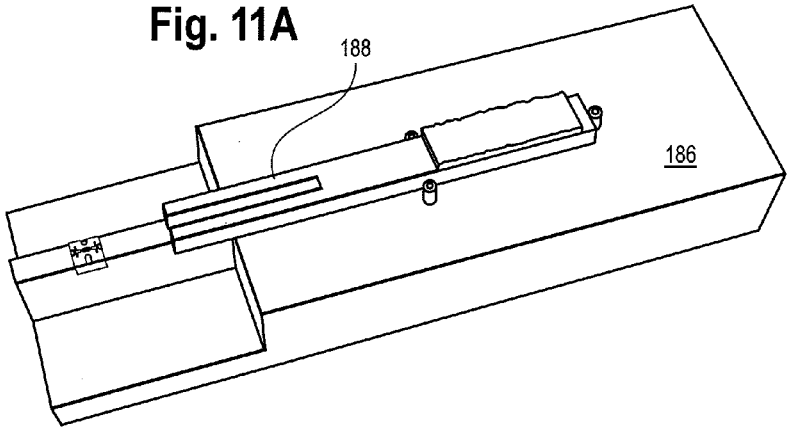
FIGS. 11A-K show an exemplary assembly method of a balanced armature motor assembly.
Figure 11B:
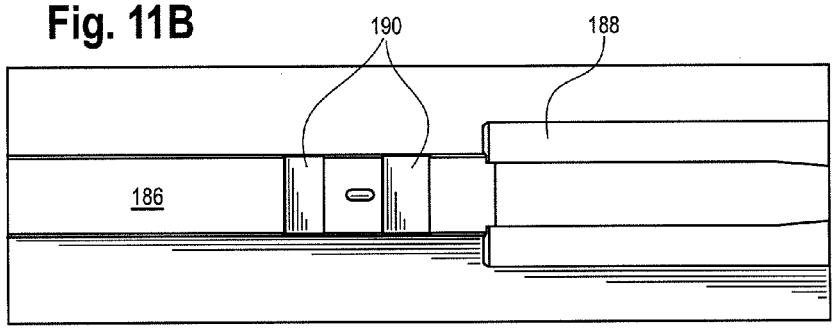

FIG. 11A shows the overall assembly fixture 186 and a guide fork 188. FIG. 11B shows the assembly fixture 186 before receiving the bobbin 162. As shown in FIG. 11D, the guide fork 188 has a first wider area 191, a transition area 192, and a narrower area 193 all of which allow the magnets 158 to be moved closer together as the guide fork 188 is moved inwardly. As shown in FIG. 11B the assembly fixture 186 has notches 190 for supporting the bobbin 162 while the magnets 158 and the pole piece 160 are assembled to the bobbin 162.

Figure 11C:
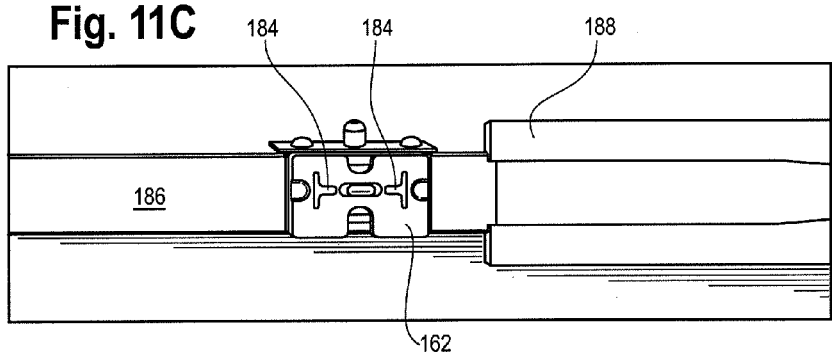
Figure 11D:
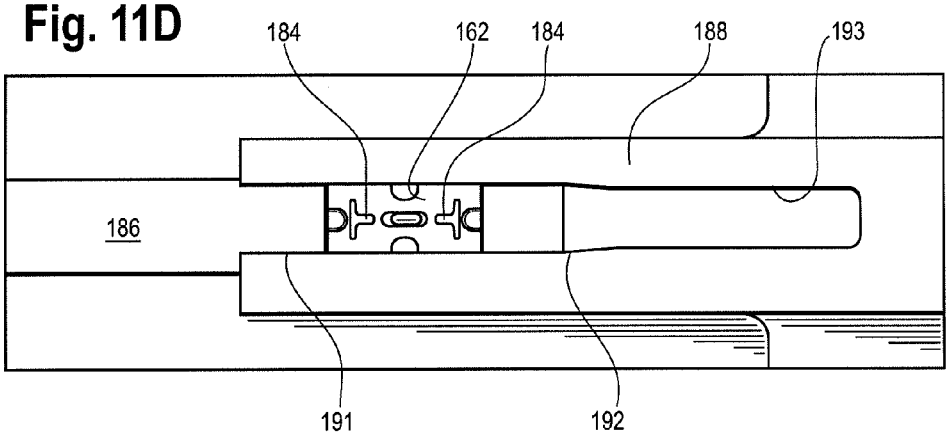
Figure 11E:
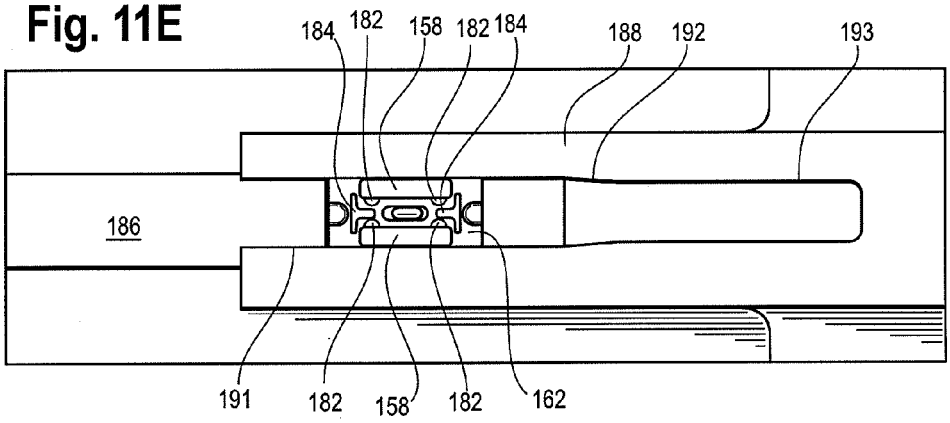
Figure 11F:
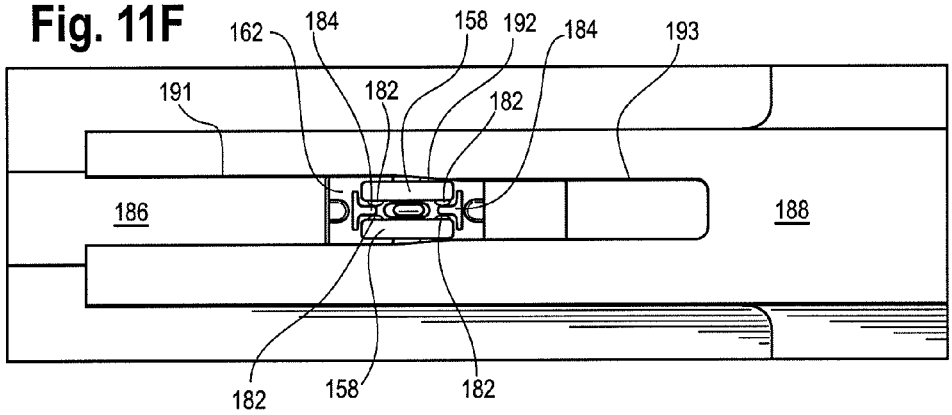
Figure 11J:
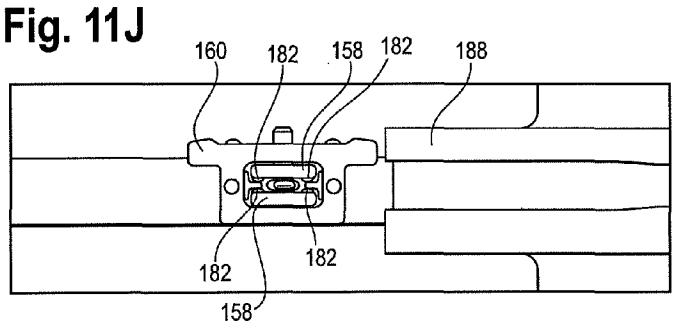
Figure 11K:
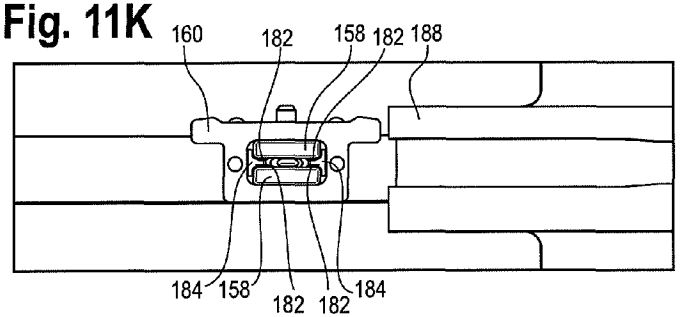
Figure 11G:
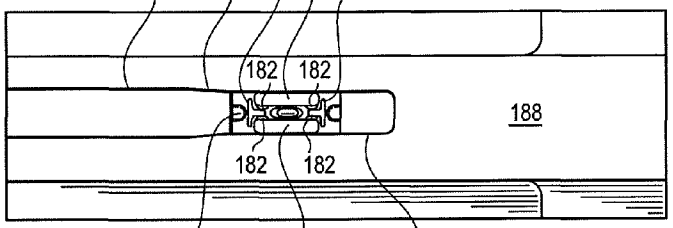

First as shown in FIG. 11C a bobbin 162 is installed in the fixture 186. Next as shown in FIG. 11D, the guide fork 188 is moved over the bobbin 162. Next as shown in FIG. 11E the magnets 158 are inserted with the glue dots 182 located on the bobbin "T" shaped posts 184 on the first wider area 191 of the guide fork 188. FIGS. 11F and 11G show the guide fork 188 being moved inwardly (to the left) into position such that the magnets 158 contact the transition area 192 and are compressed as they enter the narrower area 193 of the guide fork 188 in order to bring the magnets 158 closer together for placement of the pole piece 160. The resilient glue dots 182 are also compressed during the assembly to force the magnets 158 against the pole piece and also counteract the force provided by the guide fork 188.

Figure 6B:
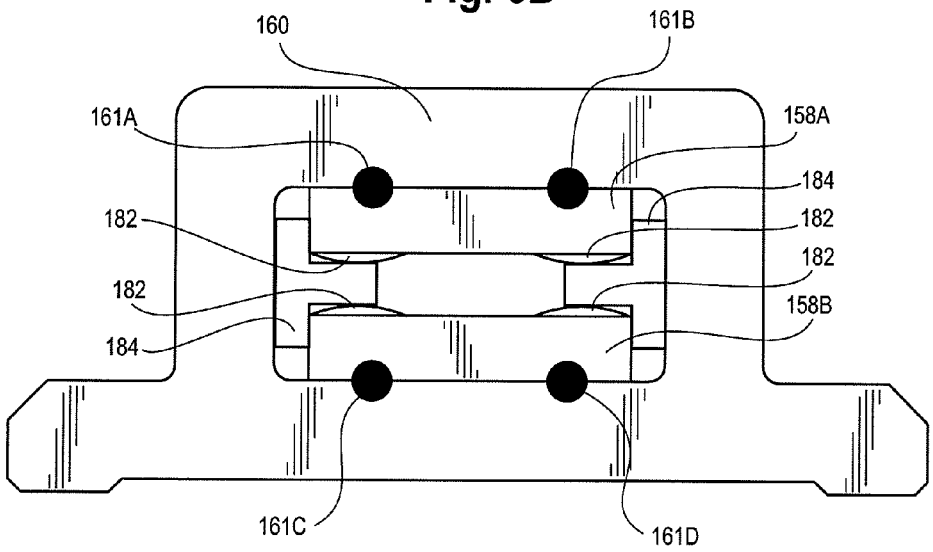
FIG. 6B shows the embodiment of FIG. 6A after a welding operation.
Figure 11H:
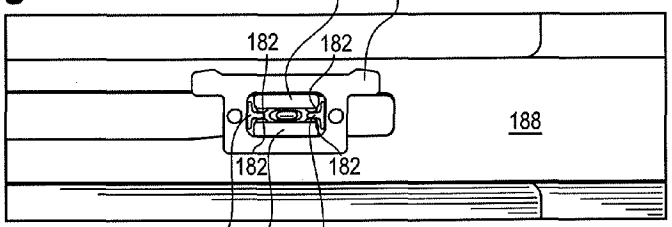
Figure 11I:
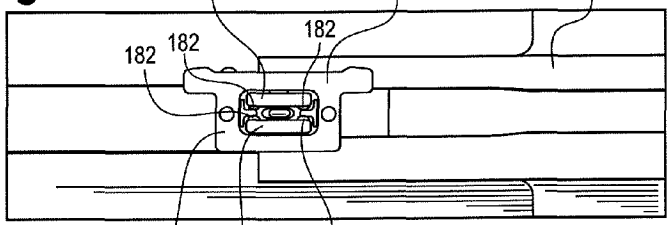

As shown in FIG. 11H, the pole piece 160 is next installed over the magnets 158. At this point the pole piece 160 is resting on top of the guide fork 188 and is located only half way down over the magnets 158, so as to aid in inserting the magnets 158 into the pole piece 160. As shown in FIG. 11I-11K, the guide fork 188 is retracted (moved to the right) and the pole piece 160 is pushed all the way down over the magnets 158. The glue dots 182 are compressed trapping the magnets 158 between the bobbin "T" shaped posts 184 and the pole piece walls. The entire assembly is then removed from the fixture 186, and the magnets 158 can then later be welded to the pole piece 160 using any suitable and known welding method, such as laser welding. FIG. 6B shows approximate weld locations 161A-D between the magnets 158A, 158B and the pole piece 160. Thus, the glue dots 182 both secure the magnets 158 into position in the pole piece 160, and hold them in proper place until a later welding operation is conducted.

In an embodiment, the glue can have an elongation property of 150% when fully cured, which provides for adequate compressibility. For consistency in manufacturing and operation, it is preferable that the glue dot 182 be of a consistent height (+/−0.001") and be accurately located on the magnet 158. This can be accomplished with proper fixturing and controlled dispensing of the adhesive. The compliance of the glue dot 182 takes up the tolerance in the assembly while providing enough force to keep the magnets 158 against the pole piece 160.

A suitable adhesive that may be used to form the glue dots 182 is Dymax 3013-T, which is a compliant elastomeric adhesive. However, other adhesives and suitable polymers are contemplated. In an embodiment, the glue dots 182 are shaped roughly hemispherically after being dispensed, and are 'pancaked' under compression during the assembly process described in FIGS. 11A-11K.

Figure 10:
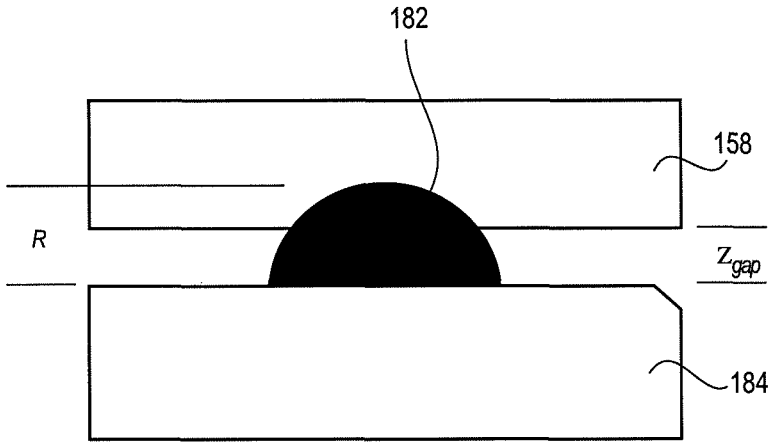
FIG. 10 shows a representative schematic of an exemplary embodiment disclosed herein.

The relative forces provided by each glue dot are based on factors such as material property, amount of compression, and size of each dot. As shown in FIG. 10, the glue dot 182 can be modeled as a hemisphere having a radius (R) and the amount of force can be treated like a linear spring with the exception that, as the gap between the bobbin and the magnet ($z_{gap}$) is reduced linearly, the volume changes exponentially ($3^{rd}$ power) per the below equation. In FIG. 10, the glue dot 182 is shown in an uncompressed state, while magnet 158 and portion of the post 184 are shown in a typical compressed spacing illustrating a $z_{gap}$ less than radius R. The optimal design will match the adhesive dot size capability with the system tolerances that impact the gap.

$$v_{comp} = \frac{2}{3}\pi(R - z_{gap})^3$$

Figure 12:
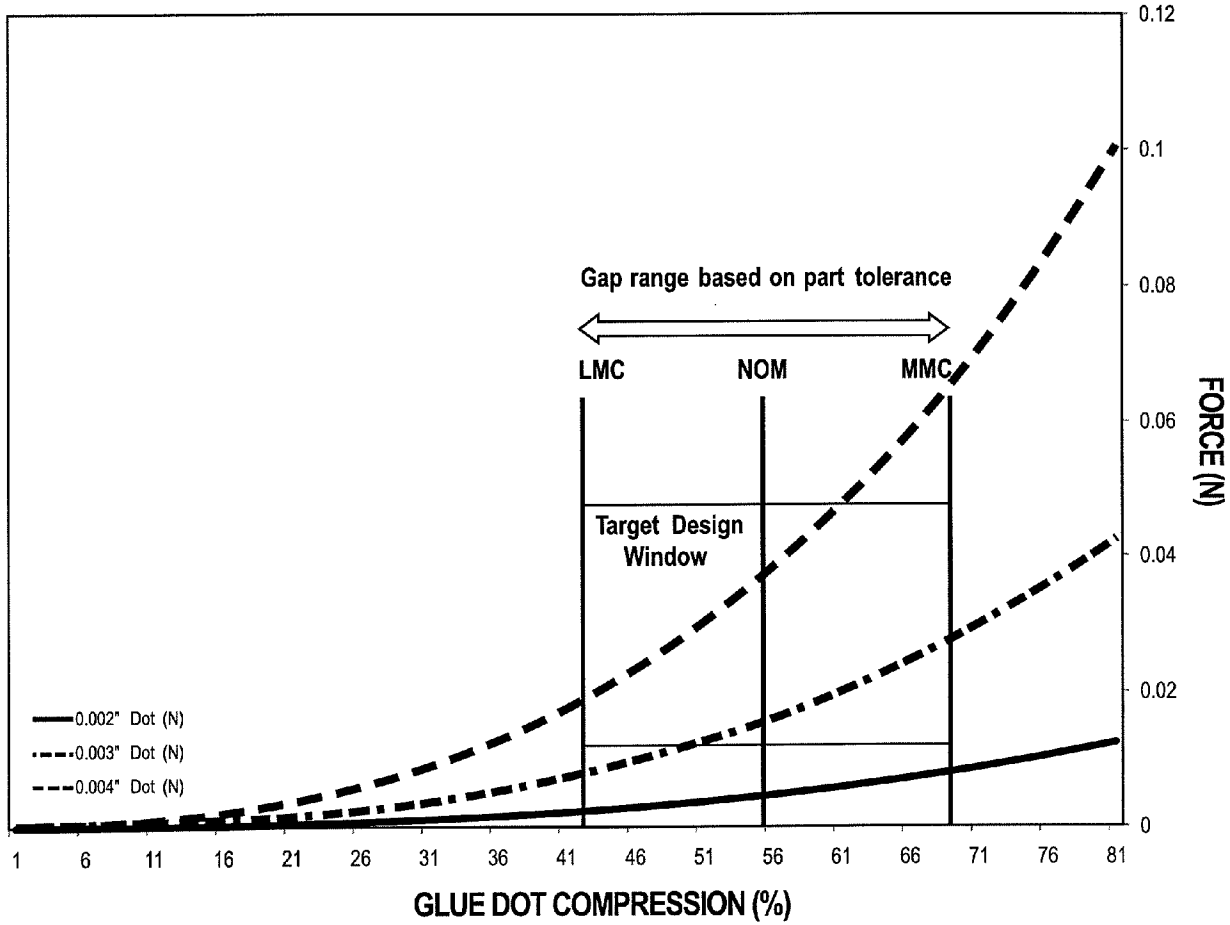
FIG. 12 shows a graph of comparing glue dot size, compression percentage, and force for an exemplary embodiment disclosed herein.

Estimated forces that will be provided by the glue dots can be calculated by multiplying the displaced volume ($v_{comp}$) by a spring factor (e.g. modulus of elasticity). The exact force may not be easily predictable due to the complex nature of the system behavior and imperfect "hemispheres," but for design purposes the graph shown in FIG. 12 shows example system tolerances (bobbin, magnet, pole piece) along with the varying impact of different glue dot heights.

The graph shows glue dot compression as a percentage (%) on the x-axis verses force (N) on the y-axis. The top line (dashed) shows the comparison for a dot size of 0.004 in., the middle line (dash-dot) shows the comparison for a dot size of 0.003 in., and the bottom line (solid) shows the comparison for a dot size of 0.002 in. There is a feasible region that works within the least material condition "LMC" (largest gap between the bobbin and the magnet), and maximum material condition "MMC" (smallest gap between the bobbin and the magnet). An LMC/MMC range of the parts to establish a gap is shown as a target design window in FIG. 12. The target design window shows an acceptable region for the glue dots 182.

In an alternative embodiment, structures known as "crush ribs" can be molded to the bobbin to arrange the magnets in the pole piece. The ribs can be located half way back along the length of the posts of the bobbin, in an area under the outer edges of the magnets. This also would allow the magnets to be tilted towards each other in the front, as the pole piece is installed over them. As the pole piece is fully installed, the magnets would pivot back around the crush rib to a parallel position, and be forced against the walls of the pole piece by the crush rib. A type of spring or rubber part is also required in this embodiment to keep pressure on the magnets holding them tight against the pole piece.

Aspects of the invention have been described in terms of illustrative embodiments thereof. Numerous other embodiments, modifications and variations within the scope and spirit of the disclosed invention will occur to persons of ordinary skill in the art from a review of this entire disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. A balanced armature motor assembly comprising:
- an armature having a flexible reed;
- a pole piece containing a pair of magnets;
- a bobbin comprising a first cutout, a second cutout, and a center post;
- a wire coil surrounding the bobbin having a first end and a second end;
- a circuit board mounted to the bobbin, the circuit board comprising a first terminal and a second terminal; and
- a drive pin operatively connected between the reed and a paddle; wherein the first end of the wire coil is secured to the first terminal of the circuit board and passes through the first cutout of the bobbin and the second end of the wire coil is secured to the second terminal of the circuit board and passes through the second cutout of the bobbin.

2. The assembly according to claim 1, wherein the first end of the wire coil is oriented along a first line tangent to the center post of the bobbin and the second end of the wire coil is oriented along a second line tangent to the center post of the bobbin.

3. The assembly according to claim 1 wherein the circuit board comprises first and second notches and wherein the first end of the wire coil is located in the first notch of the circuit board and the second end of the wire coil is located in the second notch of the circuit board.

4. The assembly according to claim 2 wherein the first cutout and the second cutout in the bobbin are both L-shaped.

5. A method of forming a balanced armature motor assembly comprising an armature having a flexible reed, a pole piece containing a pair of magnets, a bobbin, a wire coil, a drive pin, a paddle, and a circuit board having first and second terminals thereon, the method comprising:
- wrapping a first end of a wire around a center post located on the bobbin;
- placing a portion of the first end of the wire in a first cutout located on the bobbin;
- wrapping a central portion of the bobbin with the wire to form the wire coil;
- locating a portion of a second end of the wire in a second cutout located on the bobbin; wrapping the second end of the wire around the center post; and
- affixing the first end of the wire to the first terminal and the second end of the wire to the second terminal.

6. The method of claim 5, further comprising cutting the first end of the wire between the first terminal and the center post and discarding a first remainder portion of the first end wrapped around the center post.

7. The method of claim 5, further comprising cutting the second end of the wire between the second terminal and the center post and discarding a second remainder portion of the second end wrapped around the center post.

8. The method of claim 4 wherein the first and second ends of the wire are attached to the first and second terminals by a thermo-compression or soldering process.

9. A balanced armature motor assembly comprising:
- an armature having a flexible reed;
- a pole piece housing a first magnet and a second magnet;
- a bobbin having at least one post extending therefrom;
- a wire coil surrounding the bobbin;
- a circuit board mounted to the bobbin;
- a drive pin operatively connected to the reed and to a paddle; and
- a compressed polymer material interposed between the first magnet and the post and between the second magnet and the post, the polymer material forcing the first and second magnets into contact with the pole piece.

10. The assembly according to claim 9 wherein the polymer material comprises at least one glue dot secured to each of the first magnet and the second magnet.

11. The assembly according to claim 10 wherein the polymer material comprises a plurality of glue dots located on each of the first magnet and the second magnet.

12. The assembly according to claim 10 wherein the at least one post comprises a pair of T-shaped posts and wherein the at least one glue dot on the first magnet rests on a first side of the T-shaped posts.

13. The assembly according to claim 12 wherein the at least one glue dot on the second magnet rests on a second side of the T-shaped posts.

14. The assembly according to claim 9 wherein the first magnet and the second magnet are further welded to the pole piece.

15. A method of forming a balanced armature motor assembly comprising an armature having a flexible reed, a pole piece containing a first magnet and a second magnet, a bobbin, a wire coil, a drive pin, a paddle, and a circuit board, the method comprising:

placing a polymer material on the first magnet and the second magnet;

positioning the first magnet and the second magnet such that the polymer material contacts at least one post extending from the bobbin;

placing the pole piece over the first magnet and the second magnet and compressing the polymer material to cause the polymer material to force the first magnet and the second magnet into contact with the pole piece; and securing the first magnet and the second magnet to the pole piece.

16. The method according to claim 15 wherein the polymer material comprises an adhesive.

17. The method according to claim 16 wherein the adhesive comprises a plurality of glue dots on each of the first magnet and the second magnet.

18. The method according to claim 15 wherein the step of compressing the polymer material comprises moving the magnets inwardly towards each other.

19. The method according to claim 16 wherein the securing step comprises welding the first and second magnets to the pole piece.

20. The method according to claim 15, wherein the at least one post comprises a pair of T-shaped posts extending from the bobbin.

* * * * *